US005101654A

United States Patent [19]

Stevens

[11] Patent Number: 5,101,654

[45] Date of Patent: Apr. 7, 1992

[54] APPARATUS FOR PULLING DEFORMATIONS FROM METAL FRAME STRUCTURES

[76] Inventor: James F. Stevens, 1330 NW. 102 St., Miami, Fla. 33147

[21] Appl. No.: 685,206

[22] Filed: Apr. 15, 1991

[51] Int. Cl.[5] ..... B21D 1/12

[52] U.S. Cl. ..... 72/447; 72/705

[58] Field of Search ..... 72/705, 447

[56] References Cited

U.S. PATENT DOCUMENTS

| | | | |
|---|---|---|---|
| 3,149,660 | 9/1964 | Smith | 72/705 |
| 3,543,561 | 12/1970 | Taber | 72/705 |
| 3,698,230 | 10/1972 | Buske | 72/705 |
| 3,835,692 | 9/1974 | Hoffman | 72/705 |
| 4,712,417 | 12/1987 | Jarman et al. | 72/705 |

*Primary Examiner*—Lowell A. Larson
*Attorney, Agent, or Firm*—Malloy, Downey & Malloy

[57] ABSTRACT

A frame pulling apparatus for applying multiple pulling forces to a damaged structure such as an automobile, and including two or more pulling stations slidably mounted on, and adjustably positionable between a pair of vertically extending parallel support posts extending upwardly from a base. Each of the pulling stations includes a hydraulically actuated cylinder disposed within a telescopically extending power post and a load chain directed about a pulley at the end of the power posts, wherein actuation of the cylinders causes telescopic extension of the power posts thereby applying a pulling force equally on two independently extending legs of the load chain, the legs being separately attached to the damaged structure.

6 Claims, 5 Drawing Sheets

APPARATUS FOR PULLING DEFORMATIONS FROM METAL FRAME STRUCTURES

BACKGROUND OF THE INVENTION

The present invention relates to a frame pulling apparatus for applying a plurality of pulling forces to a damaged metal frame structure such as an automobile, for the purpose of restoring the structure to its original configuration. More specifically, the present invention relates to a frame pulling apparatus having a plurality of pulling stations, each pulling station adapted to apply a pulling force on two legs of a chain extending from the apparatus and secured to the damaged structure, wherein each pulling station is adapted to apply two independent pulling forces at two separate locations on the damaged structure.

Ordinarily, when a metal structure is damaged, such as an automobile, it is necessary to apply a number of pulling forces to the damaged area in order to restore the structure to its original configuration. Specifically, when an automobile is involved in a collision, there is usually extensive damage to the vehicle's body as well as the frame. In order to repair the damage, it is necessary to apply various forces in a substantially opposite direction from the direction of impact forces which caused the damage. Essentially, the damaged area must be pulled out in an opposite manner in which the area was impacted. To do this, it has been generally known to use various frame pulling machines, which are known in the related art and are used quite extensively in the auto body repair business Almost all of these frame pulling machines are adapted to pull a chain secured to a location within the damaged area. Some of the frame pulling machines in the related art are adapted to pull several chains simultaneously, wherein each chain is connected at or near one end to a location within the damaged area of the automobile. Included in the related art are the frame pulling machines as disclosed U.S. Pat. Nos. 4,848,132; 3,955,397; 4,747,579; and 4,574,613. A common characteristic with each of the frame pulling machines known in the related art is that each pulling chain used is adapted to apply only one pulling force to the damaged area, being connected thereto at only one end. Because it is often necessary to apply a number of forces simultaneously at different locations within the damaged area in order to properly "pull out" the damaged area in a substantially opposite manner in which the area was impacted, applying only one pulling force per chain substantially limits the effectiveness of the repairing operation.

Accordingly, the frame pulling apparatus of the present invention has been specifically designed so as to apply an equal pulling force to two legs of a single chain, thereby doubling the efficiency of each load chain and associated pulling station, and substantially reducing the time required to complete the job.

SUMMARY OF THE INVENTION

It is therefore an object of the present invention to provide a frame pulling apparatus adapted to apply a pulling force to a damaged structure such as an automobile, wherein a single pulling station is adapted to apply an equal pulling force on two legs of a single chain with each leg being attached to a separate location within the damaged area.

It is another object of the present invention to provide a frame pulling apparatus for applying a pulling force to a damaged area of a metal structure such as an automobile, wherein the apparatus includes a plurality of pulling stations, with each pulling station being adapted to apply two separate pulling forces to the damaged area so as to effectively pull out and restore the damaged area to its original configuration.

It is a further object of the present invention to provide a frame pulling apparatus having collapsible wheels thereon which are adapted to be easily operated between a collapsed position and a lowered operable position, thereby facilitating transport of the apparatus between use locations.

It is still another object of the present invention to provide a frame pulling apparatus which is designed to apply a plurality of pulling forces at various locations within a damaged area of an automobile or like structure so as to restore the damaged area to its original configuration more effectively and efficiently than presently known frame pulling machines in the related art.

Briefly, in accordance with a preferred embodiment of the present invention, there is provided a frame pulling apparatus comprising a pair of vertical support posts extending upwardly from a base in spaced, parallel relation to one another. A plurality of pulling stations are adjustably mounted to the support posts and are generally disposed therebetween, each of the pulling stations including a housing which is slidable along the length of the support posts so as to be adjustably positionable in a plurality of fixed, adjusted positions. A power post is telescopically fitted within the housing and includes a chain pulley rotatably mounted to a; distal end thereof. A hydraulically actuated cylinder is fitted within the power post being structured and disposed to move the power post and attached chain pulley between a normal, relaxed position an extended, pulling position upon actuation thereof. A load chain is associated with each of the pulling stations, with each load chain being directed through the housing and about the chain pulley on one side of the housing, leaving two legs of the load chain extending from an opposite side of the housing for attachment to the damaged area to be repaired. With the apparatus secured to the ground surface, using a number of securing chains, the hydraulic cylinders in each of the pulling stations can be independently actuated so as to move the power post from the normal, relaxed position to the extended, pulling position, thereby applying an equal force to both legs of the chain attached at different locations to the damaged area. Springs attached to and extending between the housing and the distal end of the power post apply a biasing force to pull the power post back to the normal, relaxed position upon the deactuation of the hydraulic cylinder. To facilitate transport of the apparatus, collapsible wheels are attached to the base, including a pair of rear wheels and a front wheel. The front wheel is hingedly mounted to the base so as to move between a collapsed position and a lower, operable position and is further pivotal relative to the base so as to direct movement during transport.

The invention accordingly comprises the features of construction, combination of elements, and arrangement of parts which will be exemplified in the description hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
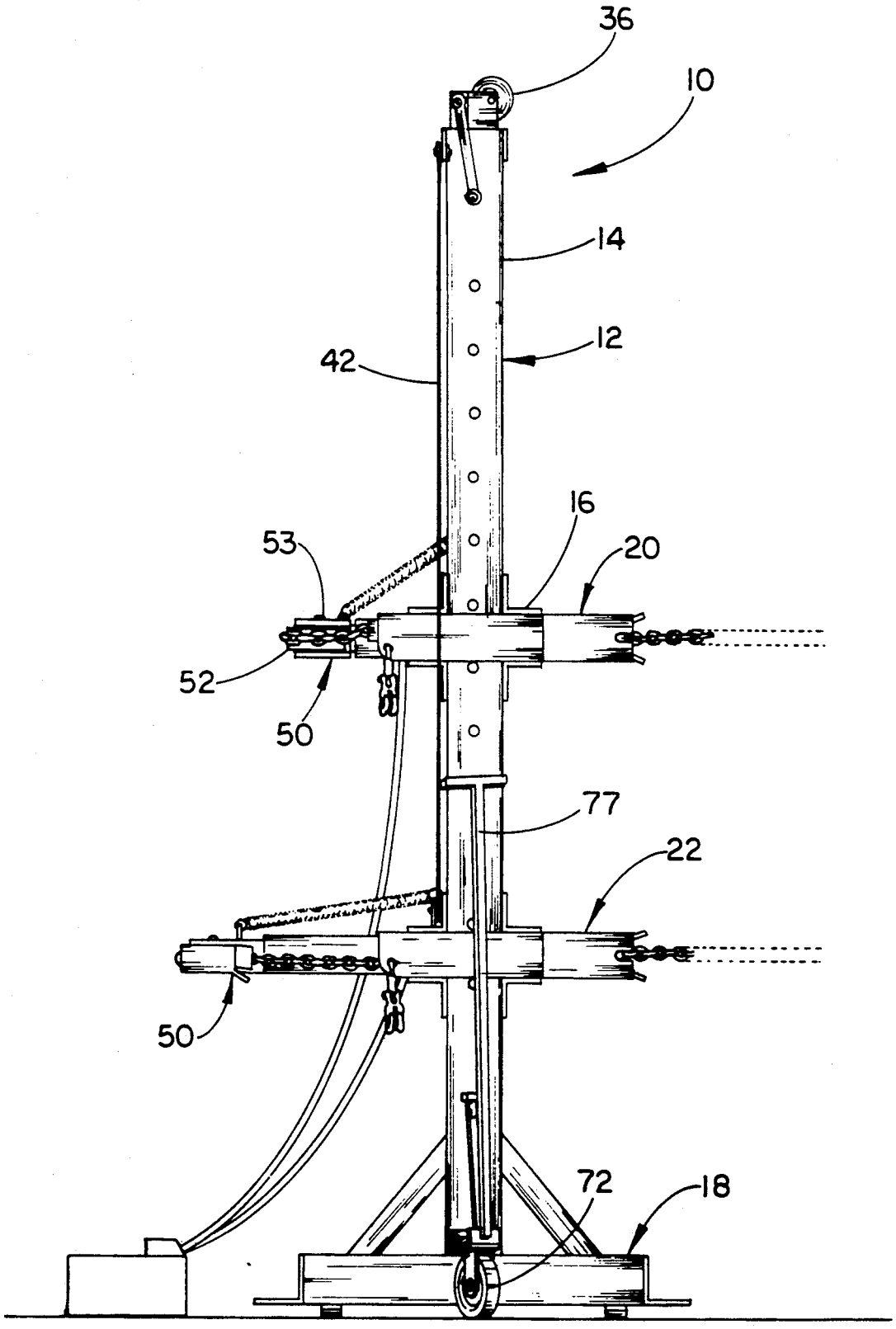
FIG. 1 is a side elevational view of a preferred embodiment of the frame pulling apparatus of the present invention.
Figure 2:
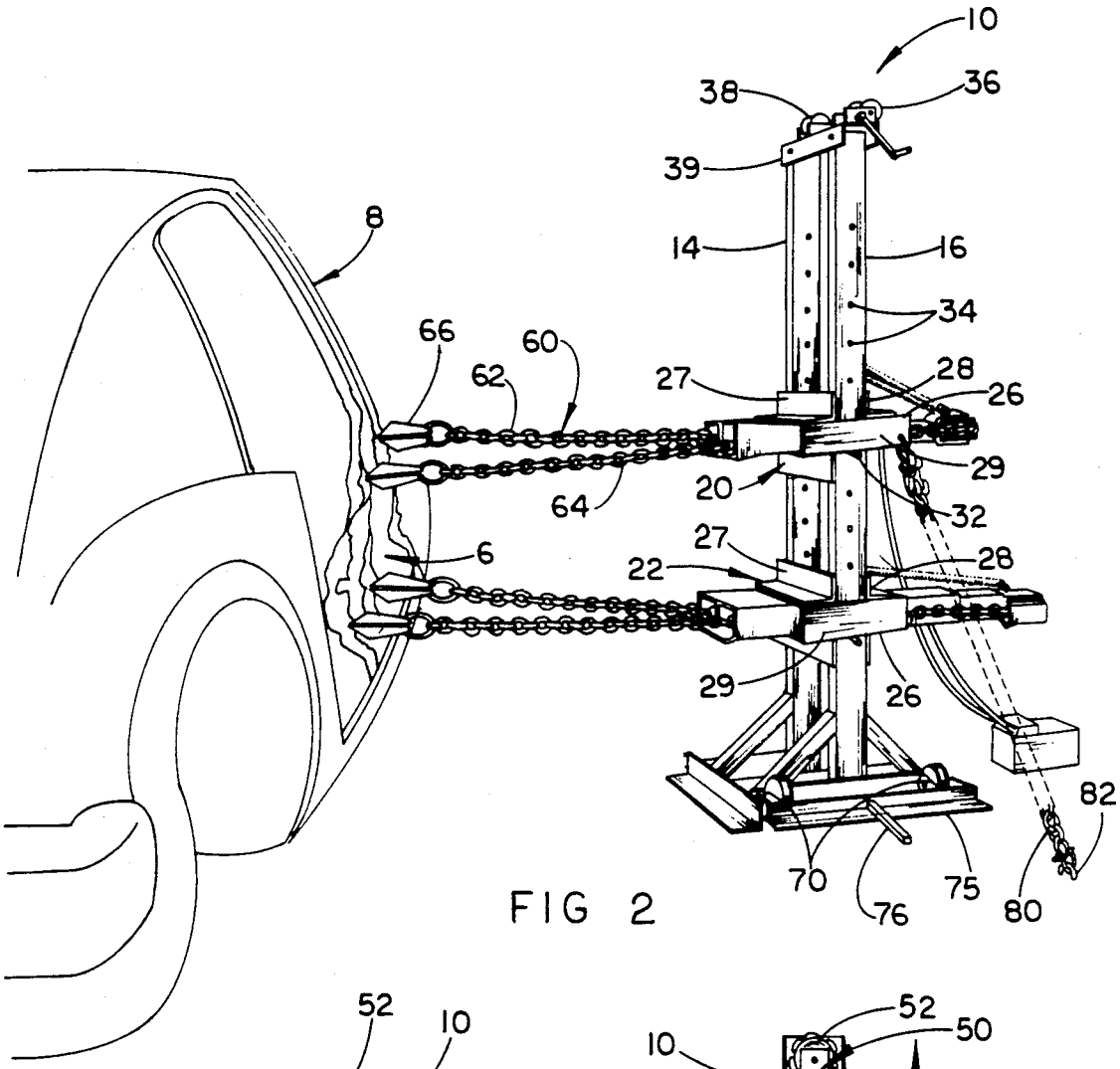
FIG. 2 is a perspective view generally illustrating the manner in which the frame pulling apparatus is used to repair a damaged area of an automobile.

With reference to the drawings, an initially to FIGS. 1 and 2, the present invention is directed to a frame pulling apparatus, generally indicated as 10, adapted to apply a pulling force at various locations to a damaged area 6 of a metal structure such as an automobile 8 so as to restore the damaged area 6 to its original configuration. The frame pulling apparatus 10 includes a vertical support structure 12 including two vertically extending support posts 14 and 16 (as seen in FIG. 2) extending upwardly from a base frame structure 18. In the preferred embodiment, two pulling stations 20 and 22 are adjustably mounted to the support posts 14, 16 and each including a housing 26 slidably mounted to and extending between the support posts 14, 16 so as to be adjustably positionable along a length thereof in a plurality of fixed, adjusted positions. The housing 16 of each pulling station 20, 22 includes a front and rear face 27 and 28 which slidably engage a front and rear of the support posts 14 and 16 and side plates 29 which engage an outer side of the support posts 14 and 16.

The pulling stations 20 and 22 are adjustably positionable at fixed positions along the length of the support posts 14 and 16 and are held at a specific fixed position by a pair of support pegs 32 (one on each side of the housing 26) with the sides 29 of the housing 26 resting thereon. The support pegs 32 are removably positionable between various spaced apart apertures 34 disposed at spaced intervals along the length of the support posts 14 and 16. A pair of winches 36 and 38 are mounted to a top plate 39 connecting between the top ends of the support posts 14 and 16 wherein a cable 42 runs from each winch 36, 38 and connects to the housing 26 of a respective one of the two pulling stations 20, 22 so as to facilitate raising and lowering the pulling stations 20, 22 along the length of the support posts 14, 16.

Each of the pulling stations 20, 22 includes a power post 50 telescopically mounted within the housing 26 and extending from a rear side thereof. Each power post 50 in the pulling stations 20, 22 includes a chain pulley 52 rotatably mounted about an axle 53 at a distal end thereof.

Each of the pulling stations 20, 22 further includes a load chain 60 extending through the housing 26 and about the chain pulley 52 at the distal end of the power post 50 with two legs 62, 64 extending out from an opposite side of the housing 26 and connecting to the damaged area 6 using conventional clamps 66.

The base frame structure 18 includes a collapsible wheel assembly including a pair of rear wheels 70 (as seen in FIG. 2) and a front wheel 72. The rear wheels 70 are coaxially mounted to the base frame structure 18 and are interconnected by connecting bar 75 having a handle 76 extending therefrom. Referring to FIG. 1, the front wheel 72 is hingedly attached to the base 18 and is pivotal relative thereto. An extended handle 77 is pivotally attached to the front wheel structure to facilitate pulling of the apparatus 10 between different use locations. The function and operation of the collapsible wheels 70 and 72 will be discussed in more detail hereinafter.

Once the apparatus 10 is positioned in a desired location for pulling, a plurality of securing chains 80 are connected to chain claws 81 at various locations on the apparatus 10. The securing chains 80 are further connected at opposite ends to eyelets 82 located at various locations about the supporting ground surface. The securing chains 80 hold the apparatus 10 in a fixed position during pulling preventing the apparatus 10 from moving or tipping when pulling on the damaged area 6.

Figure 3:
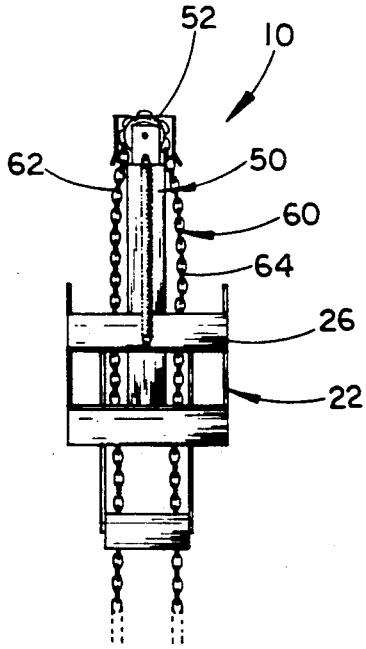
FIG. 3 is a top plan view of a pulling station in the preferred embodiment of the present invention in a normal, relaxed position.
Figure 4:
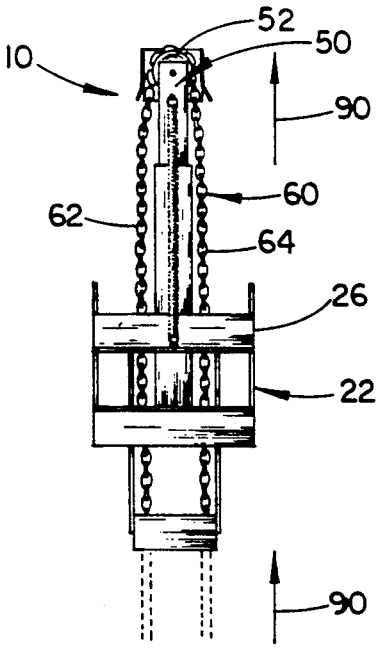
FIG. 4 is a top plan view of the pulling station in an extended, pulling position.
Figure 5:
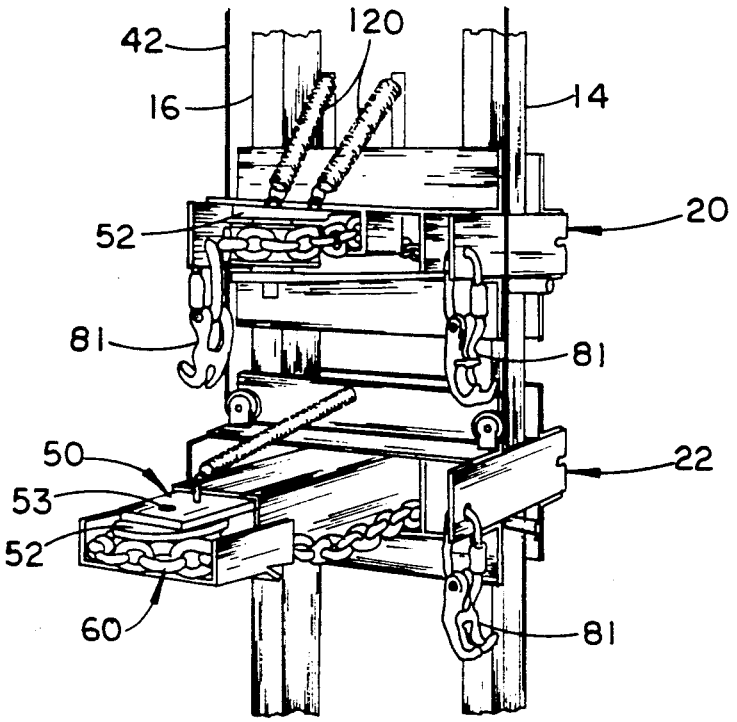
FIG. 5 is a perspective view illustrating two separate pulling stations slidably mounted to vertical support posts of the present intention.

Referring to FIGS. 3 and 4, a hydraulically actuated cylinder (seen in FIG. 8) is disposed within the power post 50 and is adapted to move the power post and attached chain pulley 52 outwardly away from the support posts 14 and 16 and the damaged area 6 being pulled, in accordance with the directional arrows 90 seen in FIG. 4. Thus, the power post 50 is movable between a normal, relaxed position as seen in FIG. 3 and an extended, pulling position, as seen in FIG. 4, wherein a pulling force is applied to both legs 62, 64 of the load chain 60 in the direction of the arrows 90. The pulling force exerted on the chain 60 serves to pull out the damaged area 6 at the locations where the legs 62 and 64 of the chain 60 are attached. In the preferred embodiment, a 10 ton hydraulic cylinder is used whereupon a force of five tons is exerted on each of the legs 62, 64 of the load chain 60 during pulling. Depending upon the strength of the cylinder used, the amount of force exerted by each chain can be varied between pulling stations 20, 22. Often, a larger pulling force is necessary from the lower pulling station 22 which is usually attached to stronger and more rigid structure on the automobile 8. It is sometimes desirous to have a lesser pulling force from the pulling station 20 having the legs 62, 64 of the load chain 60 attached to somewhat more delicate structure on the automobile 8.

Figure 6:
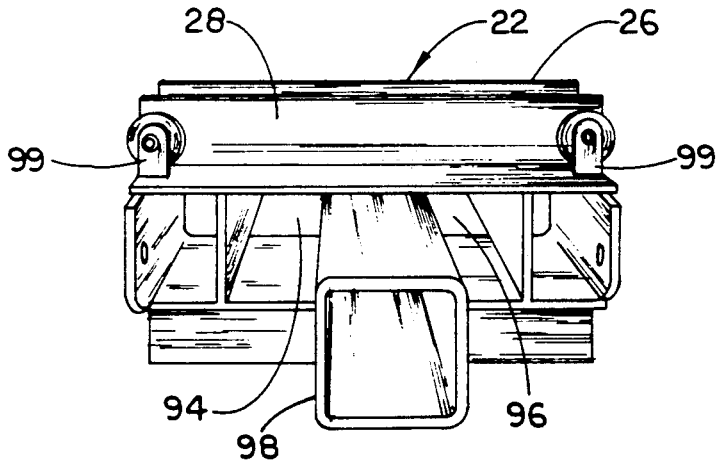
FIG. 6 is a rear perspective view of a housing of a pulling station of the present invention.
Figure 7:
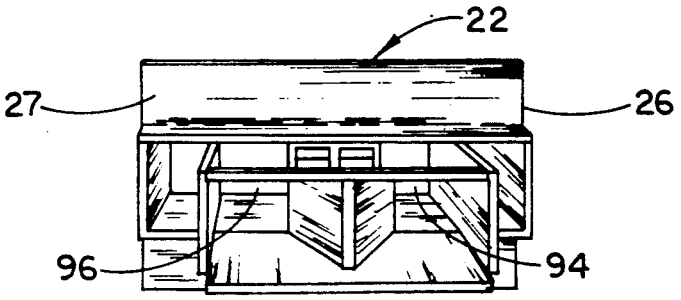
FIG. 7 is a front perspective view of the housing of FIG. 6.

Referring to FIGS. 6 and 7, the housing 26 of a pulling station is illustrated and includes two oppositely disposed channels 94 and 96 for passage of the legs 62, 64 of the load chain 60 therethrough. A tubular extension member 98 is disposed on a substantial center line of the housing 26 and extends outwardly from a rear side thereof. The extension member 98 is specifically structured and configured for telescopic receipt of the power post 50 and the hydraulic cylinder therein. Pulleys 99 can be provided at opposite ends of the housing 26 for passage of the cable 42 therethrough to facilitate raising and lowering of the housing 26 on the support posts 14, 16.

Figure 8:
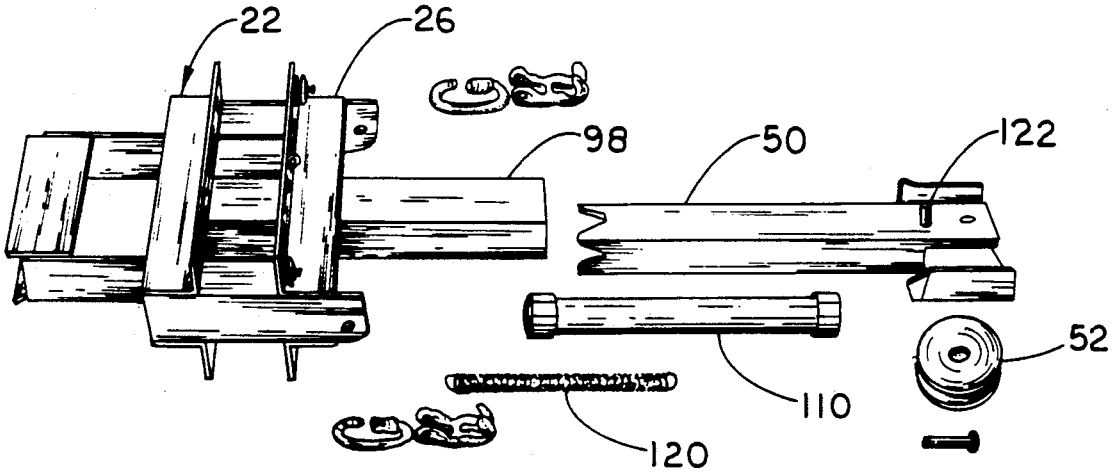
FIG. 8 is an exploded view, shown in perspective, illustrating the structural features of a pulling station of the present invention.
Figure 9:
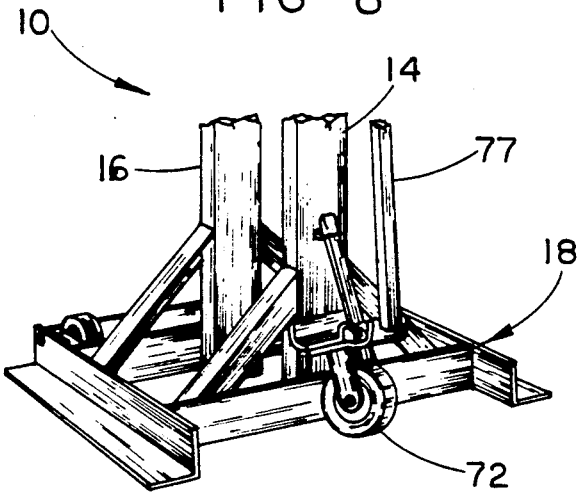
FIG. 9 is an isolated view, shown in perspective, illustrating a base and collapsible wheel assembly of the present invention.
Figure 10:
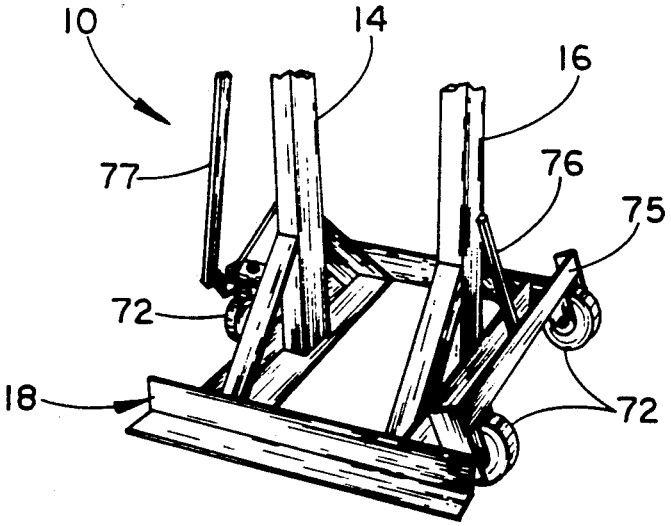
FIG. 10 is a perspective view of the base of the present invention.

FIG. 8 illustrates an exploded view of the structural features of a pulling station 20, 22 including the housing 26 with the tubular extension member 98 extending outwardly from a rear side thereof. A hydraulic cylinder 110 is fitted within the power post 50 which is then telescopically inserted through an open end of the tubular extension member 98. The chain pulley 52 is rotatably mounted to the distal end of the power post 50 with a pin 53 which serves as an axle. A spring 120 is attachable at opposite ends to the housing 26 and a pin 122 on an upper side of tee power post 50 adjacent the chain pulley 52, so as to apply a biasing force on the power post 50 urging the power post back to the normal relaxed position, as seen in FIG. 3, once the hydraulic cylinder 110 is deactuated.

Figure 11:
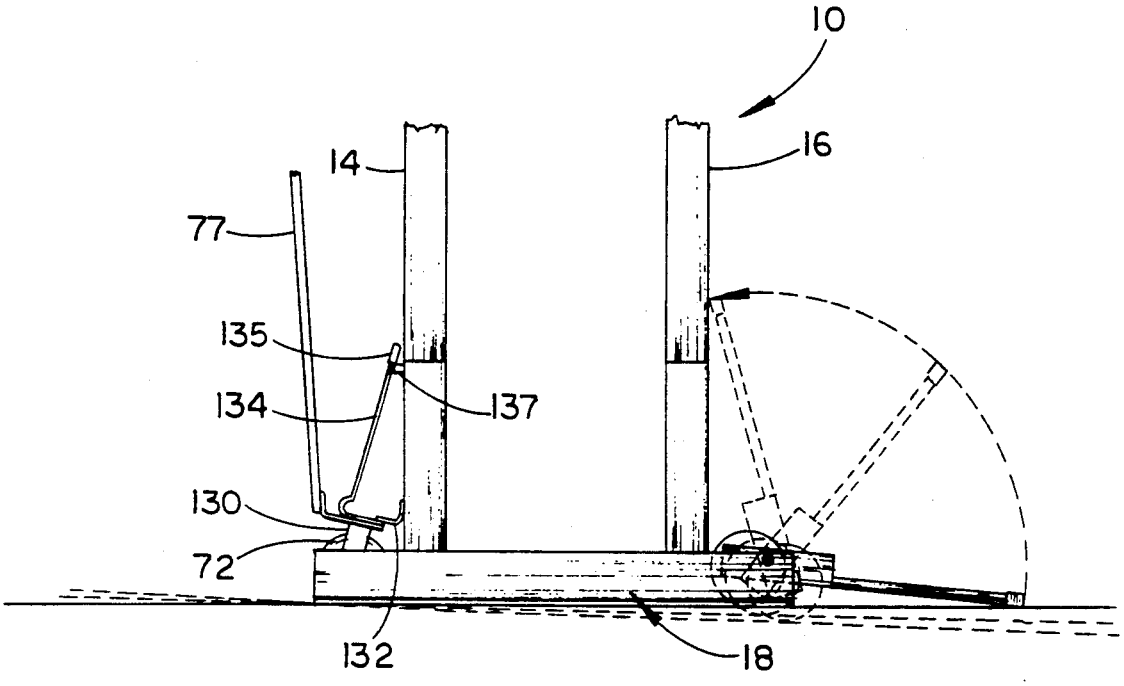
FIG. 11 is an isolated side view of the base illustrating operational movement of rear wheels thereof.
Figure 12:
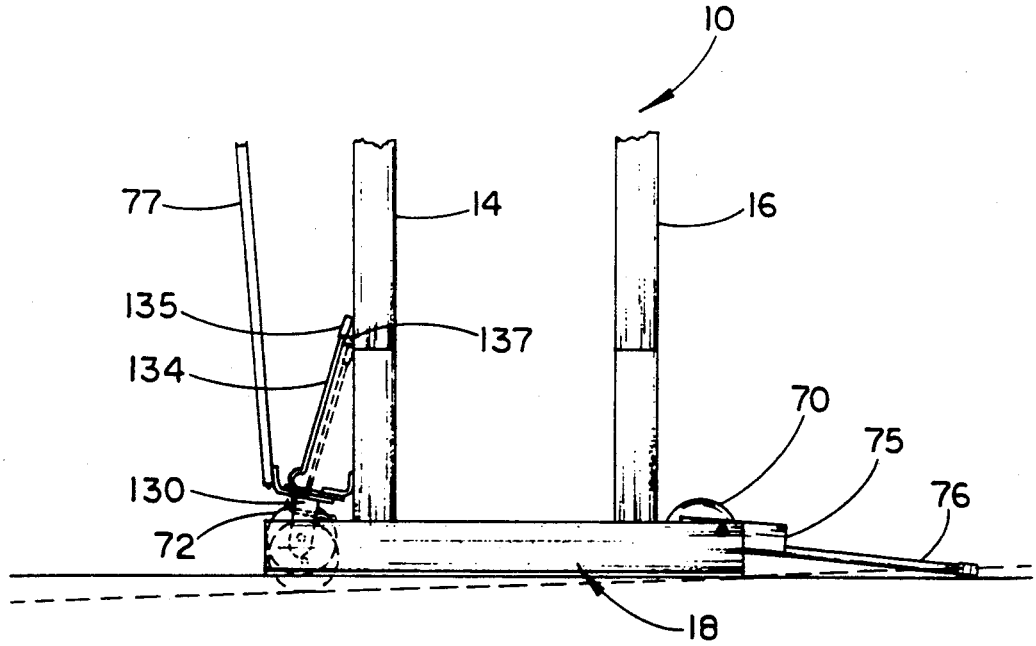
FIG. 12 is a side plan view of the base of the present invention illustrating operational movement of a front wheel thereof.

The collapsible wheel assembly on the base 18 of the apparatus 10 is best seen in FIGS. 9 through 12 and includes the rear wheels 70 and front wheel 72 as earlier discussed. The rear wheels 70 are coaxially mounted to the connecting bar 75 so as to rotate about a common axis. The connecting bar 75 is further pivotally mounted to the base 18, the pivotal mounting being eccentric to the common axis of the wheels 70. In this manner, as the handle 76 is moved from a lowered position upwardly through an arc, as seen in FIG. 11, to a position against the support posts 16, the wheels 70 are kicked out from a raised position to a lowered position so as to engage the supporting ground surface.

The front wheel 72 includes a wheel mount structure 130 having a top plate which is hingedly mounted at 132 to the support post 14 so as to be movable between, collapsed position and a lowered, rolling position. A lever arm 134 is attached to the wheel mounting structure 130 and includes a distal end 135 which locks under a knob 137 extending outwardly from the front of the support post 14. To engage the distal end 35 with the knob 137, the apparatus is tilted by applying pressure to the support post 14 near an upper portion thereof, so as to lean the apparatus 10 until the distal end 35 of the lever arm 134 slides down along the support post 14 and under the knob 134 with the wheel 72 remaining in contact with the supporting ground surface. Once the distal end 135 is below the knob 137, the apparatus can be tilted back to its normal upright position so as to exert pressure on the front wheel 72 thereby forcing the lever arm 74 upwardly into jamming relation against the knob 137.

Now that the invention has been described,

What is claimed is:

1. A frame pulling apparatus for applying simultaneously a plurality of pulling forces to a damaged structure at a plurality of locations thereon, said apparatus comprising:

a base structured and disposed to support said apparatus in a substantially upright position and including collapsible wheels thereon to facilitate transport of said apparatus between use locations, a pair of support posts connected to and extending vertically upward from said base in parallel, spaced relation to one another, a plurality of independent pulling stations adjustably mounted to said support posts, each of said pulling stations including a housing slidably mounted between and vertically adjustable along a length of said support posts, adjustment means for adjustably positioning said plurality of pulling stations at a plurality of fixed, adjusted positions along the length of said support posts, a power post telescopically fitted within and extending from one end of said housing of each of said plurality of pulling stations and including a chain pulley rotatably mounted to a distal end thereof, each of said plurality of pulling stations further including a load chain fitted about said chain pulley and including a first and a second extension leg each extending through said housing and leading out from an opposite end thereof for attachment to the damaged structure, said housing of each of said pulling stations including a pair of oppositely disposed elongate channels each sized and configured for passage of a respective one of said first and second legs of said load chain therethrough, a hydraulically actuated cylinder disposed within said power post of each of said plurality of pulling stations, said cylinder structured and disposed to telescopically extend said power post between a normal, relaxed position and an extended, pulling position upon actuation thereof, so as to move said chain pulley in a direction substantially away from the damaged structure, applying a pulling force on said first and said second extension legs relative to the damaged structure, each of said cylinders being operable independently of other cylinders in a remainder of said pulling stations, biasing means connecting between said housing and said power post of each of said pulling stations and structured and disposed to move said power post to said normal, relaxed position upon de-actuation of said cylinder, and a plurality of securing chains connecting between said apparatus and said supporting ground surface so as to fixedly secure the apparatus in the upright position.

2. An apparatus as in claim 1 wherein said collapsible wheels include a pair of co-axial rear wheels eccentrically mounted to said base relative to central axles thereof, so as to be swingably movable between a lowered position and a raised position, said raised position defined by disengagement of said rear wheels with a supporting round surface.

3. An assembly as in claim 2 wherein said collapsible wheels further include a front wheel hingedly attached to said base and pivotal relative thereto, said front wheel including a locking lever adapted to releasably lock said front wheel between a raised, collapsed position and a lowered, rolling position.

4. An apparatus as in claim 3 wherein said collapsible wheels further include an extended handle pivotally attached to said front wheel structure for facilitating pulling of the said apparatus between different use locations.

5. An apparatus as in claim 4 further comprising at least one winch mounted to a top connecting plate extending between top ends of said support posts, said winch being structured and disposed to facilitate raising or lowering of said plurality of pulling stations between said fixed, adjusted positions and including a cable extending therefrom and connecting to said housing.

6. An assembly as in claim 5 wherein said adjustment means includes a plurality of apertures disposed in spaced relation along the length of each support post, said apertures adapted to receive support pegs therein, wherein said housing is supportably maintained in said fixed, adjusted position on a pair of said support pegs each fitted within a correspondingly positioned aperture on a respective one of said support posts.

* * * * *